United States Patent [19]

Day

[11] Patent Number: 4,482,315

[45] Date of Patent: Nov. 13, 1984

[54] BULK TOBACCO BARN FURNACE

[76] Inventor: Harding W. Day, Rte. 4, Box 112, Roxboro, N.C. 27573

[21] Appl. No.: 531,446

[22] Filed: Sep. 12, 1983

[51] Int. Cl.[3] ..... F27B 7/00

[52] U.S. Cl. ..... 432/189; 34/210; 34/226; 34/230; 110/233; 432/200; 432/500

[58] Field of Search ..... 110/233, 235; 34/210, 34/213, 215, 91, 226, 230; 432/159, 176, 186, 189, 500

[56] References Cited

U.S. PATENT DOCUMENTS

| | | | |
|---|---|---|---|
| 204,592 | 6/1878 | Melvin | 432/500 |
| 4,011,041 | 3/1977 | Taylor | 432/500 |
| 4,212,634 | 7/1980 | Mitchell et al. | 432/500 |
| 4,247,992 | 2/1981 | MacGregor | 34/91 |
| 4,267,645 | 5/1981 | Hill | 34/215 |
| 4,424,024 | 1/1984 | Wilson et al. | 432/500 |

*Primary Examiner*—Edward G. Favors
*Assistant Examiner*—Steven E. Warner
*Attorney, Agent, or Firm*—B. B. Olive

[57] ABSTRACT

An auxiliary wood furnace for a bulk curing tobacco barn is arranged for installation in a basement immediately below the conventional oil or gas fired furnace for ease of barn modification and adaptation to burning wood as the source of heat.

4 Claims, 5 Drawing Figures

BULK TOBACCO BARN FURNACE

DESCRIPTION

1. Technical Field

The invention relates to bulk tobacco barns and specifically to auxiliary wood-burning furnaces for heating such barns.

2. Background Art

Bulk tobacco curing barns are in widespread use and utilize various forms of heat including oil burners, gas burners, wood burners, and, to a very limited extent, solar energy. The oil and gas burner furnaces are the most popular type and typically incorporate a fan, plenum chambers, and ducts arranged to circulate the heat produced by the furnace through the tobacco leaves being cured. The bulk-type tobacco barn apparatus is sold by a number of companies and various forms of such bulk tobacco barn apparatus are well known.

As the cost of fuel has risen, the farmer's interest in burning wood for tobacco curing increases. Such interest is indicated, for example by way of background, in U.S. Pat. Nos. 4,212,634 and 4,267,645, both of which relate to auxiliary wood-burning bulk tobacco barn furnaces. Additionally, the use of a wood furnace was one of the early practices in barn curing tobacco. However, in spite of the effort expended to date on auxiliary wood-burning furnaces for bulk tobacco curing, there has not come into widespread use a practical wood-burning furnace for bulk tobacco curing. More specifically, the art has not provided a wood-burning furnace which can be installed immediately below the existing oil or gas furnace and which can, with minimal modification of existing structure, be added to the conventional oil- or gas-burning type bulk barn furnace and used either as a sole or supplementary source of heat. Thus, the achieving of an improved wood-burning furnace that can use the existing fan of a conventional oil or gas burner, that can be easily installed with minimum change of existing structure and that can be used either as a sole or supplementary source of heat becomes the object of the invention. These and other objects will become apparent as the description proceeds.

DISCLOSURE OF THE INVENTION

The wood-burning bulk tobacco barn furnace of the invention is adapted to be installed directly below a conventional oil or gas furnace and its fan. The firebox of the invention furnace mounts a heat exchanger which provides multiple passes of the flue gases through heat exchanger tubes over which the air being heated is drawn by utilizing the conventional oil or gas burner fan. A thermostat controlled auxiliary blower introduces extra combustion air when required to bolster the amount of wood furnace heat produced. The conventional oil or gas burner furnace can remain operative for use independently or in conjunction with the wood-burning furnace of the invention.

BEST MODE FOR CARRYING OUT THE INVENTION

Figure 1:
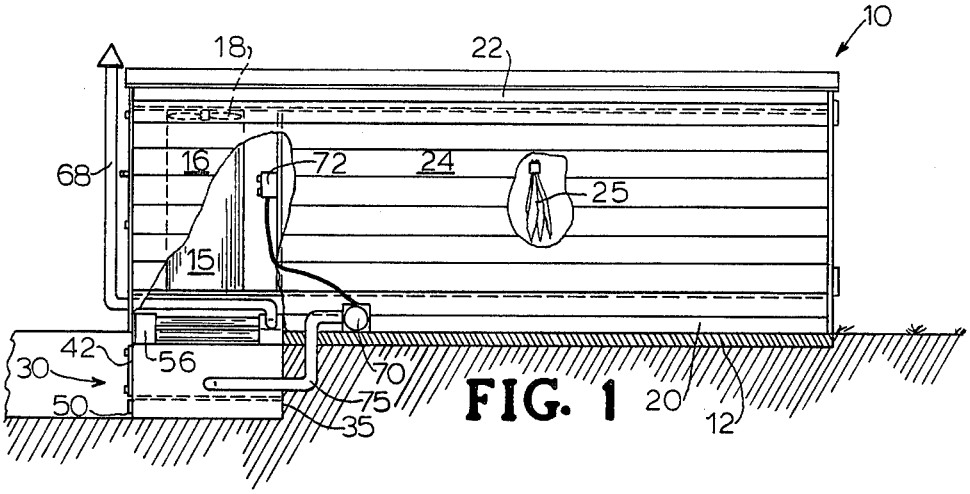
FIG. 1 is a side elevation, partially cutaway view of a bulk tobacco barn equipped with the auxiliary wood furnace of the invention.
Figure 2:
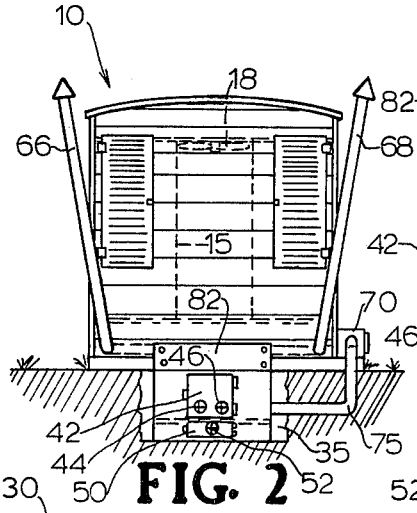
FIG. 2 is a front elevation view of the modified bulk tobacco barn shown in FIG. 1.

Referring to the drawings and specifically to FIGS. 1 and 2, there is illustrated a conventional lengthwise extending bulk tobacco barn 10 modified according to the invention. Barn 10 typically sits on a concrete slab 12 and is assumed to be of the type having a conventional oil or gas fired furnace 15 in a front furnace compartment 16 with an electrically powered fan 18 for circulating hot air through furnace 15 and through a confined path including a lower plenum chamber 20 below the tobacco 25 being cured in heating compartment 24 and an upper plenum chamber 22. In some such bulk tobacco barns 10, the fan 18 is designed to rotate in a direction to force the heated air down through the tobacco 25 whereas in other bulk tobacco barns 10 the rotation of fan 18 is such as to cause the hot air to be drawn upward through the tobacco 25 during curing. The present invention adapts to either mode of operation. Conventional controls not shown allow fan 18 to be operated independently or in conjunction with operating the burner for furnace 15.

Figure 3:
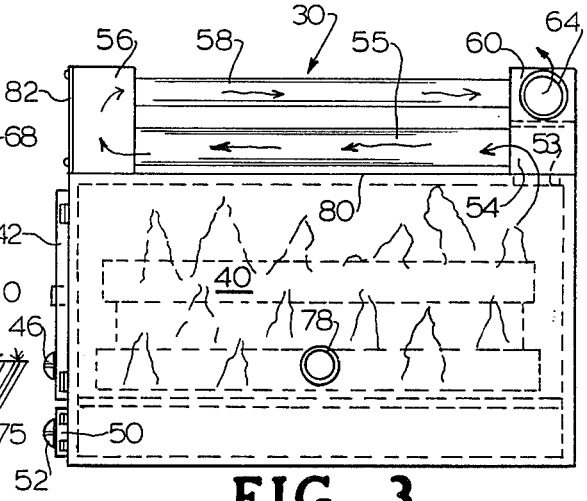
FIG. 3 is a side elevation view of the auxiliary wood furnace of the invention.
Figure 4:
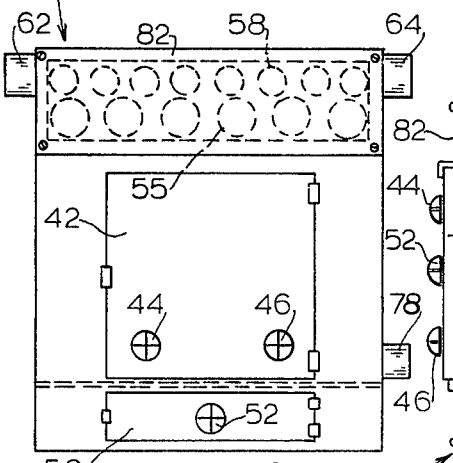
FIG. 4 is a front elevation view of the auxiliary wood furnace of the invention.
Figure 5:
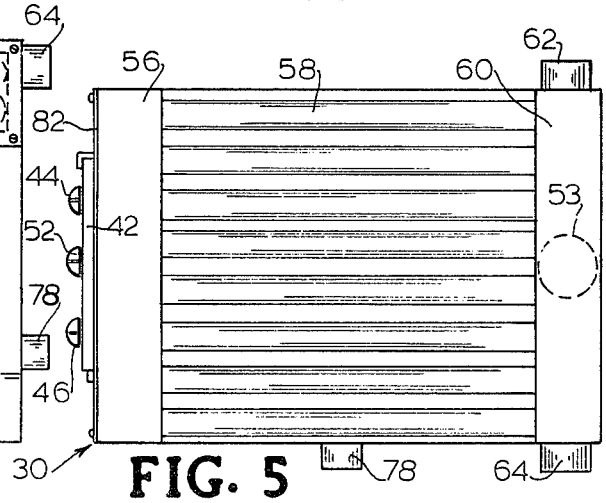
FIG. 5 is a top plan view of the auxiliary wood furnace of the invention.

In order to install the auxiliary wood-burning furnace 30 of the invention, the details of which are best shown in FIGS. 3–5, the conventional concrete slab 12 which normally extends for the full length of the barn structure 10 is cut away below furnace compartment 16 so as to provide a suitable excavation or basement 35 directly below the conventional oil furnace 15 for receiving furnace 30. The conventional oil or gas furnace fan 18 can thus be used to draw the air being heated over heat transfer furaces of the furnace 30 of the invention. Assuming that oil or gas furnace 15 is of the type in which the fan 18 causes the hot air to be forced upwardly through the tobacco 25, it will be seen that the air to be heated is drawn along a confined path from the upper plenum chamber 22 through fan 18, through the conventional burner support structure of oil or gas furnace 15, over the heat exchange surfaces of the auxiliary wood-burning furnace 30 of the invention, as later explained in more detail, then through plenum chamber 20 and up through the tobacco 25 being cured in heating compartment 24.

Furnace 30 of the invention incorporates a firebox 40, a door 42 fitted with adjustable vents 44, 46, and an ash removing door 50 fitted with an additional vent 52. The flue gases exiting the firebox 40 are fed through opening 53 in a lower connecting box 54 to a set of lower, horizontal, laterally-spaced, heat transfer pipes 55, then to a connecting box 56 to a set of upper horizontal, laterally-spaced, heat transfer pipes 58 from which the flue gases pass to an upper connecting box 60, the outer ends of which are formed with outlets 62, 64 which in turn are connected to flue gas exhaust pipes or stacks 66, 68, generally directed vertically and sufficient to provide an appropriate draft in the firebox 40. Lower pipes 55 are purposely of larger diameter and of less number than the upper pipes 58 to enhance the heat transfer effect.

In order to provide extra combustion air when needed, an auxiliary electrically-powered blower 70 controlled by a suitably placed thermostat 72 forces extra combustion air through a pipe 75 connected through an inlet 78 to the firebox 40. Thus, the amount of combustion air can be controlled by the mentioned vents 44, 46 and 52 as well as by operation of the blower 70.

In addition to the heat transfer surfaces provided by the mentioned connecting boxes 54, 56 and 60 and the upper and lower heat transfer pipes 55, 58, the invention furnace unit is also designed so that the air forced towards the furnace 30 not only contacts the mentioned heat transfer surfaces but also is forced over the top plate 80 of the firebox 40. While not shown in detail, it will also be appreciated that the floor of furnace compartment 16 is suitably formed to allow air flowing through the oil or gas furnace 15 to flow over the heat transfer surfaces of the auxiliary wood-burning furnace 30 of the invention. Also, an appropriate opening is made to communicate plenum chamber 20 with the heat transfer surfaces of furnace 30, access to which is provided by a removable plate 82.

In summary, then it can be seen that the auxiliary wood-burning furnace 30 of the invention provides the tobacco farmer with a means for easily modifying the conventional oil oil- or gas-burning bulk tobacco barn 10 for using wood as a fuel and thus economizing on the cost of energy. Additionally, it will also be noted that the auxiliary wood-burning furnace 30 of the invention does not require modification of the conventional oil furnace 15 which can thus remain operative for use whenever it is desired not to burn wood as a source of heat.

What is claimed is:

1. A bulk tobacco curing apparatus, comprising:

(a) barn structure extending lengthwise and establishing at one end and over a major portion of the length thereof a heating compartment and at the opposite end a furnace compartment and establishing a confined path for recirculating air therethrough, said barn structure being supported on the ground and in a manner and by means establishing a plenum chamber below said heating compartment and between said heating compartment and the ground and a basement chamber located below said furnace compartment, said basement chamber extending downwardly below the level of said plenum chamber;

(b) an individually controllable burner fired heat source in the nature of an oil- or gas-fired furnace located in said furnace compartment and operatively associated with said heating compartment and having an individually controllable associated electrically-powered fan for blowing air circulated along said path; and (c) a wood-burning furnace located in said basement chamber below said oil- or gas-fired furnace, said wood-burning furnace having:

(i) a firebox;

(ii) an adjustably vented door for loading said firebox;

(iii) a heat exchange unit vertically spaced above said firebox, below said oil- or gas-fired furnace and in substantial vertical alignment with said fan and including sets of tubes connected at one end for receiving flue gases from said firebox and at the opposite exit end to vertically extending tubular exhaust stacks for exhausting said flue gases; said heat exchange unit being in flow communication with both said fan and said plenum chamber; and (iv) an auxiliary electrically-powered blower apparatus having an adjustable thermostat control responsive to the temperature of said heating compartment, a blower and connecting ducts for receiving and admitting extra combustion air to said firebox;

said wood-burning furnace heat exchange unit by reason of said location vertically below said fan and between said fan and said plenum chamber enabling heat created by said wood furnace to be employed to heat said heating compartment by flowing in said path.

2. A bulk tobacco curing apparatus as claimed in claim 1 wherein said sets of tubes comprise at least two sets of upper and lower interconnected, vertically spaced, horizontal tubes for establishing at least two passes of said flue gases through said heat exchange unit prior to discharge.

3. A bulk tobacco curing apparatus as claimed in claim 2 wherein said lower set of tubes are greater in number and of larger diameter than said upper set of tubes.

4. In a bulk tobacco curing apparatus, comprising a barn structure extending lengthwise and establishing at one end and over a major portion of the length thereof a heating compartment and at the opposite end a furnace compartment and further establishing a confined path for recirculating air therethrough, said barn structure being supported on the ground and further comprising a plenum chamber positioned below said heating compartment and between said heating compartment and the ground and a burner fired heat source located in said furnace compartment and operatively associated with said heating compartment and having an electrically-powered fan for circulating air along said confined path, the improvement comprising an alternative heating system for supplying heat to said heating compartment to assist in the curing and drying of tobacco within said heating compartment, said alternative heating system comprising a wood-burning furnace located in a basement chamber located directly below said furnace compartment and below the level of said plenum chamber and being in operative association with said electrically-powered fan and said plenum chamber, said wood-burning furnace comprising a firebox, a door for loading said firebox, a heat exchange unit vertically spaced above said firebox and below said burner-fired heat source and in substantial vertical alignment with said electrically-powered fan, said heat exchange unit being in flow communication with both said fan and said plenum chamber, and an auxiliary electrically-powered blower means communicating with said firebox for receiving and admitting extra combustion air to said firebox as needed, whereby said wood-burning furnace by reason of said location vertically below said electrically-powered fan and in flow communication with said fan and said plenum chamber enables heat created by said wood furnace to be employed to heat said heating compartment by flowing in said confined path and utilizing previously-existing said plenum chamber and previously-existing said electrically-powered fan associated with said burner-fired heat source.

* * * * *